United States Patent [19]

Swinbanks

[11] 4,171,465

[45] Oct. 16, 1979

[54] ACTIVE CONTROL OF SOUND WAVES

[75] Inventor: Malcolm A. Swinbanks, Cambridge, England

[73] Assignee: National Research Development Corporation, London, England

[21] Appl. No.: 931,951

[22] Filed: Aug. 8, 1978

[51] Int. Cl.[2] ..... F01N 1/06
[52] U.S. Cl. ..... 179/1 P; 181/206
[58] Field of Search ..... 179/1 P

[56] References Cited

U.S. PATENT DOCUMENTS

| | | | |
|---|---|---|---|
| 3,936,606 | 2/1976 | Wanker | 179/1 P |
| 4,044,203 | 8/1977 | Swinbanks | 179/1 P |
| 4,109,108 | 8/1978 | Coxon et al. | 179/1 P |

OTHER PUBLICATIONS

Journal of Sound and Vibration, vol. 27, (1973), pp. 411–436, Swinbanks.

*Primary Examiner*—William C. Cooper
*Attorney, Agent, or Firm*—Cushman, Darby & Cushman

[57] ABSTRACT

A sound wave propagated along a duct through a fluid contained in the duct is attenuated by generating sound waves from an array of sound sources spaced along the duct. Each source generates two waves travelling in opposite directions, the array being operated so that the resultant of those travelling in the same direction as the unwanted wave interferes destructively with the unwanted wave while the resultant of those travelling in the opposite direction is negligible. The array is operated in response to detection of the unwanted wave, the sound detector(s) being so positioned as to introduce a degree of acoustic coupling between the source array and the detection system.

6 Claims, 5 Drawing Figures

ACTIVE CONTROL OF SOUND WAVES

In my U.S. Pat. No. 4,044,203 and in a paper by me published in Journal of Sound and Vibration, Volume 27 (1973), pages 411–436, there are disclosed methods of attenuating a sound wave propagating in a given direction along a duct through a fluid contained in the duct, the characteristic feature of these methods (which are subsequently referred to as methods of the kind specified) being that an array of sound sources, located adjacent the wall of the duct respectively at different positions along the duct and each capable of generating a pair of sound waves which travel through the fluid respectively in opposite directions along the duct from the position of the relevant source, is operated in such a manner as to cause destructive interference to occur between the wave to be attenuated and the resultant of the waves generated by the sources and travelling in said given direction and simultaneously to cause the resultant of the waves generated by the sources and travelling in the direction opposite to said given direction to be negligible.

In specific methods of the kind specified described in the documents referred to above, the operation of the array of sound sources in the required manner is effected in response to the detection of the wave to be attenuated by a sound detection system which is effectively decoupled acoustically from the array, this detection system comprising sound detectors displaced from the array along the duct in the direction opposite to said given direction. In contrast, the present invention relies upon the deliberate introduction of a degree of acoustic coupling between the array of sound sources and a sound detection system whose output is utilised to control the operation of the array. The resultant acoustic feedback can be used to advantage in the overall design of the attenuation system, e.g. by simplifying the electronic part of the system as compared with cases in which the sound detection system is acoustically decoupled from the source array; further the overall length of the part of the duct which must be used for installation of the attentuation system can be considerably reduced as compared with cases in which the sound detection system is acoustically decoupled from the source array.

Thus according to one aspect of the invention there is provided a method of the kind specified in which the operation of the array of sources is controlled in response to the detection of sound waves propagated along the duct through the fluid in said given direction, the detection being effected by means of a sound detection system comprising at least one sound detector and arranged so that the or each detector of the system is located at a position along the duct which is displaced in said given direction from the position of at least one of the sources.

According to another aspect of the invention there is provided an apparatus for use in attenuating sound waves propagating along a duct through a fluid contained in the duct, the apparatus comprising an array of sound sources located adjacent the wall of said duct respectively at different positions along said duct, each source being capable of generating a pair of sound waves which travel through said fluid respectively in opposite directions along said duct from the position of that source, a sound detection system responsive to sound waves propagated along said duct through said fluid in a given direction and comprising at least one sound detector arranged so that each detector of said system is located at a position which is displaced in said given direction from the position of at least one of said sources, and means for utilising the output of said sound detection system to control the operation of said array of sources to cause destructive interference to occur between an unwanted sound wave propagating in said given direction along said duct through said fluid and the resultant of the waves generated by said sources and travelling in said given direction and simultaneously to cause the resultant of the waves generated by said sources and travelling in the direction opposite to said given direction to be negligible.

It is to be understood that the expressions "sound" and "acoustic" used in this specification are to be construed in a broad sense without implying any limitation of the frequency of the relevant wave motion to the audible range. It is futher to be understood that the term "sound source" includes both a single sound generating device, such as a loudspeaker, and a plurality of such devices distributed around the wall of the duct at a given axial position and operated in common; similarly the term "sound detector" includes both a single sound detecting device, such as a microphone, and a plurality of such devices located at a given axial position (for example distributed around the wall of the duct) and operating in common.

The invention will be further described and explained with reference to the accompanying drawings, in which.

The following description is concerned specifically with the case where it is required to attenuate a plane wave propagating along a duct, since this case is the simplest to treat but is applicable to a number of possible applications; it should be noted, however, that the principles involved are also applicable to cases where a wave to be attentuated is propagating along a duct in a transverse mode. As explained in the documents referred to above, when dealing with the plane wave case it is advantageous in many circumstances to use composite sound sources each comprising a plurality of sound generating devices operated in common; thus where the duct is of circular cross-section a suitable arrangement involves the use of three devices distributed symmetrically round the circumference, and where the duct is of square cross-section a suitable arrangement involves the use of four devices respectively situated centrally in the four sides. Where such composite sound sources are used it will normally also be desirable to use composite sound detectors each comprising a plurality of sound detecting devices operating in common, the layout of these devices being the same as that for the sources. In the following description it is assumed that such composite sound sources and detectors are used, but it should be noted that there are some applications, particularly those involving only frequencies which are very low relative to the duct cut-off frequency, where the precise form of the sources and detectors is not very significant.

A further general point that may conveniently be mentioned here is that in the following description the terms "downstream" and "upstream" are used to refer respectively to the directions corresponding and opposite to the direction of propagation along the duct of the wave to be attenuated (i.e. said given direction), and are not used with reference to any general flow of the fluid along the duct, which may occur in either of these directions. Where such flow occurs with a velocity that is not negligible in comparison with the velocity of sound in the fluid, the flow velocity must of course be taken into account in computing the transit time for a sound wave to travel between two positions spaced apart along the duct; the significance of this will become apparent from the following description.

Figure 1:
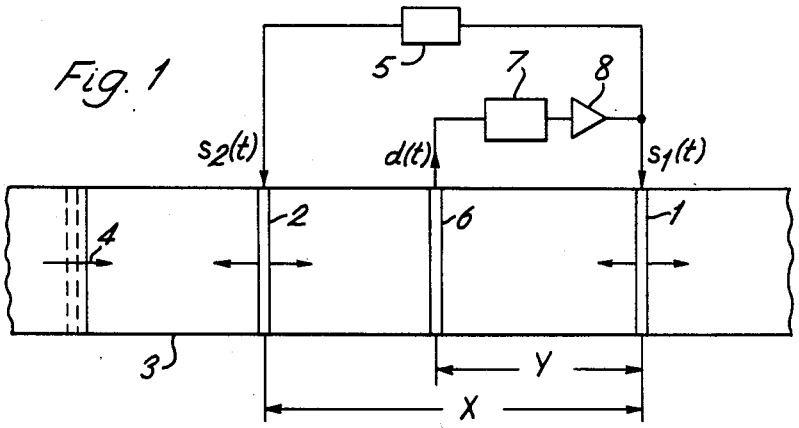
FIG. 1 illustrates diagrammatically one arrangement in accordance with the invention.

Referring now to the drawings, in the arrangement shown in FIG. 1 two similar sound sources 1 and 2 are located adjacent the wall of a duct 3 containing a fluid through which there is propagating an unwanted plane sound wave indicated at 4; the sources 1 and 2 are respectively located at positions spaced apart along the duct 3 by a distance X with the source 1 downstream of the source 2, and are each capable of generating a pair of plane sound waves which travel through the fluid respectively in the upstream and downstream directions. The sources 1 and 2 are respectively excited by electrical signals represented as functions of time by the expressions $s_1(t)$ and $s_2(t)$. In order to ensure that the array constituted by the sources 1 and 2 will not radiate sound waves upstream these signals are required to satisfy the equation $$s_1(t)+s_2(t+T_{12})=0,$$

where $T_{12}$ is the time taken for the upstream wave generated by the source 1 to reach the position of the source 2; $T_{12}$ is equal to X/V (1-M), where V is the velocity of sound in the fluid and M is the Mach number of the flow of fluid along the duct 3 (taken as positive and negative respectively for flows in the downstream and upstream directions). This requirement is met by deriving the two signals from a single source, causing the signal $s_2(t)$ to be delayed by $T_{12}$ relative to the signal $s_1(t)$ by means of a delay network 5 and applying the two signals in opposite senses to the detectors 1 and 2. Destructive interference between the upstream waves generated by the sources 1 and 2 will then ensure that there is no net output from the array in the upstream direction.

It is also required that the resultant of the downstream waves generated by the sources 1 and 2 should nullify the wave 4, and it will be appreciated that when the array is operating correctly for this purpose there will be no net plane wave pressure fluctuation at the position of the source 1. Thus in order to define the operation of the source 1(and hence also the operation of the source 2 in accordance with the equation quoted above), it is only necessary to measure the total downstream plane wave which is incident at the position of the source 1 and then operate the source 1 so that the downstream wave which it generates is equal and opposite to the incident wave. In the arrangement shown in FIG. 1, this is achieved by providing a unidirectional sound detector 6 responsive only to downstream waves and located at a position between those of the sources 1 and 2, and delaying and amplifying the output d(t) of the detector 6, by means of a delay network 7 and a linear amplifier 8, to provide the signal $s_1(t)$, this signal of course being applied to the source 1 in the appropriate sense to effect the required nullification of the wave 4 and the output of the amplifier 8 of course also being fed to the delay network 5 to provide the signal $s_2(t)$. The gain of the amplifier 8 must of course be chosen, having regard to the characteristics of the source 1 and the detector 6, to ensure the required equality of amplitude between the wave detected by the detector 6 and the downstream wave generated by the source 1, and the delay introduced by the network 7 must be equal to the time taken for the wave detected by the detector 6 to travel from the position of the detector 6 to the position of the source 1, this time being equal to Y/V (1+M), where Y is the distance between the positions of the source 1 and the detector 6.

Figure 2:
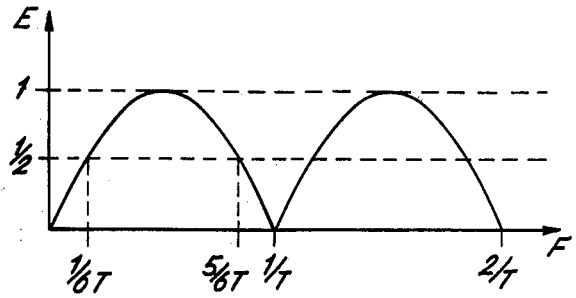
FIG. 2 is an explanatory diagram relating to the arrangement of FIG. 1.

It will be appreciated that, in accordance with the invention, the detector 6 will respond to the downstream wave generated by the source 2 as well as the wave 4, thereby introducing an acoustic feedback path. Consideraton must therefore be given to the stabilisation of the feedback loop incorporating the components 2,6,7,8 and 5. Clearly any attempt to stabilise this will result in less accurate operation of the source array, but this simply corresponds to the fact that the array has a useful frequency range of limited extent. Thus FIG. 2 shows the relative absorptive efficiency E of a two source array plotted against frequency F; the points where E=0 are precisely the frequencies at which resonance will occur in the feedback loop. This will be the case when F=(N−1)/T, where N is any positive integer and T is the total time taken for a signal to travel once round the feedback loop; this is also the time taken for a plane wave to travel once in each direction between the positions of the sources 1 and 2, and hence is equal to $2X/V(1-M^2)$. It will be noted that the useful frequency range extends over somewhat more than two octaves, the extremes of the range being at frequencies approximately equal to 1/6T and 5/6T; these values are of course dependent on the distance X, which is chosen to give a frequency range appropriate to the particular application for which the arrangement is used.

Figure 3:
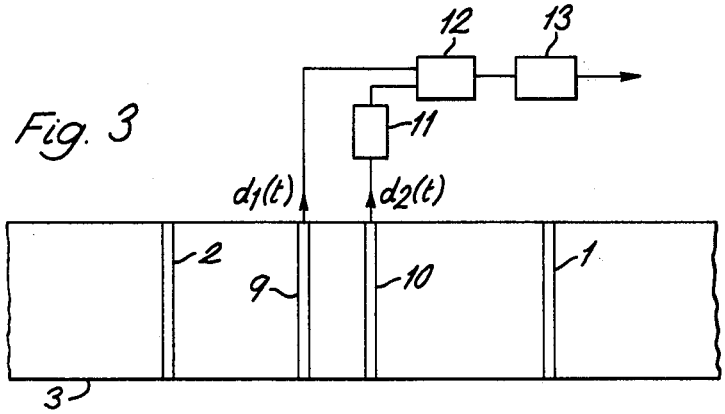
FIG. 3 illustrates diagrammatically a modification of the arrangement of FIG. 1.

A simple method of removing the instability is to insert in the electrical part of the feedback loop a D.C. filter and a low pass filter designed to become effective at the frequency 1/T. Such filters are not shown explicitly in FIG. 1 since it will frequently be convenient to design one or other of the networks 5 and 7 to provide the required filtering characteristics. It should be noted that it may well be possible to take advantage of the fact that time delays are necessary in the feedback loop to provide more accurate filtering and phase compensation than would otherwise be possible. Moreover one possible method of unidirectional detection is to use a detection system incorporating a plurality of similar detectors spaced apart along the duct 3 and having their outputs appropriately coupled together; such a detection system automatically provides a D.C. filtering characteristic. One such system is illustrated in FIG. 3, and uses a pair of detectors 9 and 10. In this system the output $d_2(t)$ from the downstream detector 10 is passed through a delay network 11 giving a delay equal to the time taken for an upstream wave to travel from the position of the detector 10 to that of the detector 9, and is then subtracted from the output $d_1(t)$ of the detector 9 in a differencing circuit 12. The resultant signal will thus depend only on the detection of downstream waves, and can be used in a similar manner to the output d(t) of the detector 6 to control the operation of the sources 1 and 2; it is necessary to pass the output signal from the detection system through a suitable network 13 to achieve a level response over the operating frequency band, but if the spacing between the detectors 9 and 10 is small this need only be a simple integrating circuit, since in this case the detection system will operate so as effectively to differentiate the incident wave.

Figure 4:
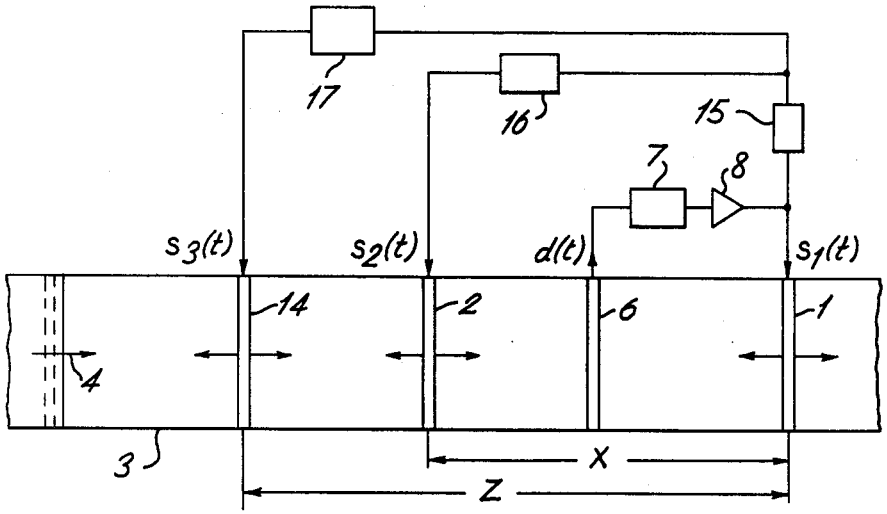
FIG. 4 illustrates diagrammatically a second arrangement in accordance with the invention.

An alternative and perhaps more satisfactory method of simultaneously achieving stability and broad band frequency coverage is to progress to an array incorporating more than two sources. An arrangement utilising three sources is illustrated in FIG. 4, in which components corresponding to those shown in FIG. 1 are given like reference numerals. In this case a third source 14 similar to the sources 1 and 2 is provided upstream of the source 2, at a distance Z from the source 1, and is excited by means of an electrical signal $s_3(t)$. In order to ensure that the source array produces no net upstream wave, the signals applied to the sources 1, 2 and 14 must now satisfy the equation:

$$s_1(t)+s_2(t+T_{12})+s_3(t+T_{13})=0,$$

where $T_{12}$ has the same meaning as before and $T_{13}$ is the time for the upstream wave generated by the source 1 to reach the position of the source 14, $T_{13}$ being equal to $Z/V(1-M)$. This is achieved by deriving the three signals from the output of the amplifier 8, causing the signals $s_2(t)$ and $s_3(t)$ to be halved in amplitude relative to the signal $s_1(t)$ by means of an attenuator 15 and to be delayed by $T_{12}$ and $T_{13}$ respectively relative to the signal $s_1(t)$ by means of delay networks 16 and 17, and applying the signals $s_2(t)$ and $s_3(t)$ to the sources 2 and 14 in the opposite sense to that in which the signal $s_1(t)$ is applied to the source 1.

Figure 5:
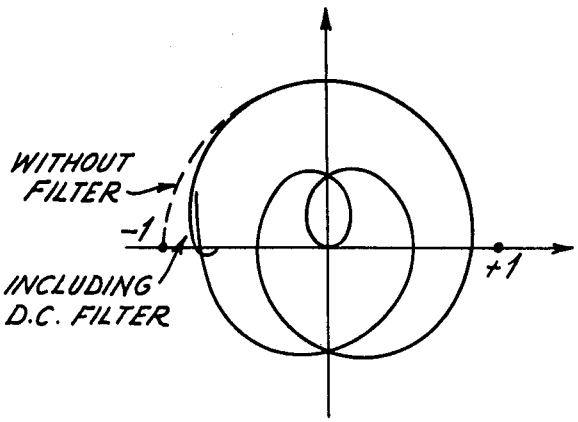
FIG. 5 is an explanatory diagram relating to the arrangement of FIG. 4.

The arrangement of FIG. 4 operates in a similar manner to that of FIG. 1, with the three source array corresponding to the superposition of two source pairs (1,2) and (1,14). The working frequency range is however extended as compared with the arrangement of FIG. 1; for further details regarding this point reference may be made to the documents mentioned at the beginning of this specification. Similar considerations in respect of stability apply as for the arrangement of FIG. 1. FIG. 5 shows the Nyquist locus for the feedback loop of the arrangement of FIG. 4 in a case where Z is chosen equal to 3.5X, including the effect of inserting a D.C. filter; some form of low pass filter will of course also have to be provided.

It should be noted that when designing a practical system incorporating the principles of the arrangments discussed above, account will need to be taken of the amplitude/phase response characteristics of the sources and the detector(s), and suitable compensation may have to be introduced into the electrical part of the system to yield a level response over the operating frequency band. As noted above, however, the fact that time delays must be introduced should permit significant flexibility in the design of the necessary compensating networks.

A further point which needs to be considered is the interaction due to the transverse modes. The position of the or each detector is in the near field of at least one source, and hence the detection system may respond to non-propagating transverse modes as well as the required plane wave components; this corresponds to the fact that in the vicinity of a source the wavefronts emanating from the individual sound generating devices are essentially spherical and only resolve into propagating modes some distance along the duct. It should, however, be a straightforward matter to simulate the effects of the transverse modes and subtract off an appropriate signal from the output of the detection system. In any event, it is envisaged that the invention will have particularly useful application in controlling low frequency noise or pressure fluctuations, well below the cut-off frequency of the duct. In such a case the interaction effects of the transverse modes are unimportant, since it should be possible to dispose the or each detector at a position far enough from the sources for these modes to have decayed to a negligible level.

In the embodiments of the invention described above the overall loop gain for the feedback loop is unity, and the acoustic feedback is used effectively only to perform the same function as the electronic feedback loops proposed in the documents referred to above for use in methods of the kind specified in which the operation of the source array is controlled by a detection system acoustically decoupled from the array. In alternative embodiments of the invention, use may be made of high gain closed loop feedback to control that source disposed further or furthest downstream in the array, so as effectively to maintain zero pressure fluctuation at the position of that source; in such embodiments, the or each other source is operated effectively only as a slave device. For example, the arrangements illustrated in FIGS. 1 and 4 may be modified by replacing the detector 6 by a detector (which at least in principle need not be unidirectional) disposed approximately at the position of the source 1 and arranged to respond to sound waves generated by the source 1 as well as to those arriving from the upstream direction, and omitting the delay network 7.

In considering the stability of such a closed loop system it is necessary to take account of two response functions, namely the in-duct source—detector transfer function and the transfer function of the chosen source array. The latter can be compensated for quite simply, since the array transfer function lies in the positive Nyquist half-plane; for example for a two source array the transfer function can be compensated for by a standard inverting circuit. The source-detector transfer function presents greater complexity, but can be dealt with by conventional techniques used in control systems, such as pole-shifting of resonant response or the use of overlapping high-Q filters with phase shifters to obtain the correct phase at the centre of each passband. It should also be noted that account may need to be taken of the possibility of reflections from acoustic impedances located downstream of the array, since if suitable precautions are not taken the feedback loop will be sensitive to sound waves propagating in the upstream direction. This can be dealt with by using in the high gain feedback loop a unidirectional detector disposed "just downstream" of the controlled source (i.e. such that it detects the immediate output of this source, but not any wave reflected from a downstream location). An alternative possibility would be to simulate the characteristics of the downstream acoustic circuit and compensate for the unwanted reflective interaction at the output of the detector.

I claim:

1. A method of attenuating a sound wave propagating in a given direction along a duct through a fluid contained in the duct, the method comprising:

generating sound waves from an array of sound sources located adjacent the wall of said duct respectively at different positions along said duct, each source generating a pair of sound waves which travel through said fluid respectively in opposite directions along said duct from the position of that source;

detecting sound waves propagated along said duct through said fluid in said given direction, by means of a sound detection system comprising at least one sound detector and arranged so that each detector of said system is located at a position along said duct which is displaced in said given direction from the position of at least one of said sources; and utilising the output of said sound detection system to control the operation of said array of sources to cause destructive interference to occur between the wave to be attenuated and the resultant of the waves generated by said sources and travelling in said given direction and simultaneously to cause the resultant of the waves generated by said sources and travelling in the direction opposite to said given direction to be negligible.

2. A method according to claim 1, in which said sound detection system is responsive only to sound waves propagated in said given direction and the position of each detector of said system is displaced in the direction opposite to said given direction from the position of only that one of said sources which constitutes the extremity of said array in said given direction.

3. A method according to claim 1, in which said sound detection system comprises a single detector located at a position along said duct which approximates to the position of that one of said sources which constitutes the extremity of said array in said given direction, said single detector being responsive to sound waves generated by said one of said sources.

4. An apparatus for use in attenuating sound waves propagating along a duct through a fluid contained in the duct, the apparatus comprising:

an array of sound sources located adjacent the wall of said duct respectively at different positions along said duct, each source being capable of generating a pair of sound waves which travel through said fluid respectively in opposite directions along said duct from the position of that source;

a sound detection system responsive to sound waves propagated along said duct through said fluid in a given direction and comprising at least one sound detector arranged so that each detector of said system is located at a position along said duct which is displaced in said given direction from the position of at least one of said sources; and means for utilising the output of said sound detection system to control the operation of said array of sources to cause destructive interference to occur between an unwanted sound wave propagating in said given direction along said duct through said fluid and the resultant of the waves generated by said sources and travelling in said given direction and simultaneously to cause the resultant of the waves generated by said sources and travelling in the direction opposite to said given direction to be negligible.

5. An apparatus according to claim 4, in which said sound detection system is responsive only to sound waves propagated in said given direction and the position of each detector of said system is displaced in the direction opposite to said given direction from the position of only that one of said sources which constitutes the extremity of said array in said given direction.

6. An apparatus according to claim 4, in which said sound detection system comprises a single detector located at a position along said duct which approximates to the position of that one of said sources which constitutes the extremity of said array in said given direction, said single detector being responsive to sound waves generated by said one of said sources.

* * * * *